United States Patent [19]

Burke

[11] Patent Number: 4,756,499

[45] Date of Patent: Jul. 12, 1988

[54] CEILING HANGER

[76] Inventor: Robert W. Burke, 5604 - 140th SW., Unit B, Edmonds, Wash. 98020

[21] Appl. No.: 59,027

[22] Filed: Jun. 8, 1987

[51] Int. Cl.[4] ..... E04G 3/00

[52] U.S. Cl. ..... 248/216.4; 248/301

[58] Field of Search ..... 248/216.1, 217.1, 216.4, 248/217.3, 71, 301, 339, 317; 411/461, 466; 24/129 B; 52/39

[56] References Cited

U.S. PATENT DOCUMENTS

| | | | |
|---|---|---|---|
| 1,308,066 | 2/1919 | Hayes | 42/96 |
| 2,653,718 | 9/1953 | Woodward | 211/105.2 |
| 2,747,821 | 5/1956 | Falk | 248/71 |
| 2,851,239 | 9/1958 | Truax | 248/339 |
| 3,032,305 | 5/1962 | Mittenzwei | 248/71 X |
| 3,279,300 | 10/1966 | Larson | 248/71 X |
| 3,282,547 | 11/1966 | Ables | 248/217.1 X |
| 3,312,442 | 4/1967 | Moeller | 248/216.1 |
| 3,323,183 | 6/1967 | Sterner | 411/466 |
| 3,620,490 | 11/1971 | Roberts | 248/216.1 X |
| 4,613,108 | 9/1986 | Sundstrom | 248/216.1 X |

FOREIGN PATENT DOCUMENTS

| | | | |
|---|---|---|---|
| 2811971 | 9/1979 | Fed. Rep. of Germany | 248/216.1 |

*Primary Examiner*—J. Franklin Foss

*Attorney, Agent, or Firm*—Christopher Duffy

[57] ABSTRACT

The hanger is generally Z-shaped and has a pointed tip on one end section and a hook on the other. The one end section is bayonetted into the ceiling until the middle section abuts the ceiling, substantially on a parallel thereto. Then, an article is suspended from the hook, with the effect that the moment generated by the article binds or jams the one end section of the hanger in the hole occupied by it, thus preventing the hanger from disengaging from the ceiling.

12 Claims, 1 Drawing Sheet

CEILING HANGER

DESCRIPTION

1. Technical Field

This invention relates to a ceiling hanger, and in particular, one which can be manually installed by bayonetting it into an overhead ceiling with one's thumb or the like, and yet, which has the capacity to support a medium weight article of up to fifteen pounds or so, such as a houseplant, without tearing free from the ceiling.

2. Background Art

Many types of ceiling hangers have been disclosed, but they commonly rely on an overlying flange element to retain the hanger on the ceiling, or a detent element which so tightly engages in a hole in the ceiling that the hanger cannot be easily pulled out of it.

DISCLOSURE OF INVENTION

The ceiling hanger of the present invention has no such flange element or detent element, but is essentially a single piece of rigid metal or other similar material which is adapted to be bayonetted into the ceiling with one's thumb or the like, and then to retain the hanger on the ceiling. This assumes, of course, that the ceiling is constructed of relatively penetrable plasterboard material or the like, as is usually the case. Alternatively, a slit-like incision may be made in the ceiling with a knife or the like, and then the hanger may be bayonetted into the slit, once again using one's thumb or the like.

According to the invention, the hanger has a rigid, generally Z-shaped body which has three successively interconnected body sections, the intermediate section of which is arranged substantially on a parallel to the ceiling in use, and the end sections of which operatively depend from the intermediate section of the hanger at one end thereof and upstand from the other end of the intermediate section, respectively. The depending end section of the hanger has a hook on the relatively lower end portion thereof, from which the article is suspended in use. The upstanding end section of the hanger has incision making means on the relatively upper end portion thereof, whereby when the intermediate section of the hanger is disposed substantially parallel to the ceiling, the upstanding end section of the same can be bayonetted into the ceiling to abut the intermediate section against the ceiling and thereby position the depending end section of the hanger below the ceiling as an attachment site for the article. Meanwhile, the hook of the depending end section is spaced apart from the connection between the intermediate and upstanding end sections of the hanger so that when the article is attached to the hanger at the hook, the article generates sufficient moment about the connection to bind or jam the upstanding end section of the hanger in the hole occupied by the same, and thus prevent the hanger from disengaging from the ceiling.

As indicated earlier, the hole may be preformed with a knife or the like, or it may be formed in situ by the upstanding end section of the hanger as it is bayonetted into the ceiling.

Preferably, the intermediate and upstanding end sections of the hanger are disposed at slightly less than 90-degrees to one another, to aid in the binding effect achieved by the downward force of the article on the hook. In addition, the hook is preferably disposed on the same side of the depending end section of the hanger, as is the intermediate section thereof.

The incision making means commonly take the form of a pointed tip on the relatively upper end portion of the upstanding end section of the hanger.

BRIEF DESCRIPTION OF THE DRAWING

These features will be better understood by reference to the drawing wherein a presently preferred embodiment of the invention is illustrated.

In the drawing.

BEST MODE FOR CARRYING OUT THE INVENTION

Figure 1:
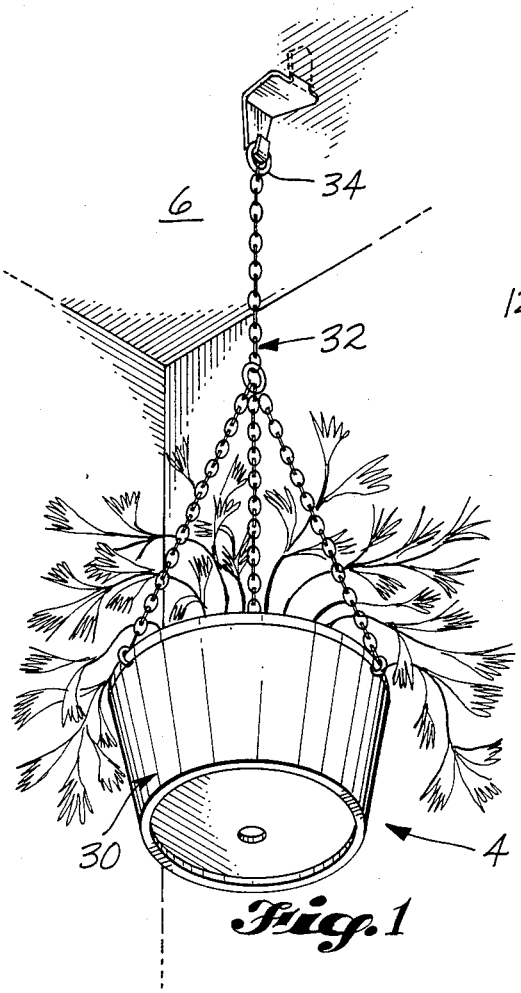
FIG. 1 is a perspective view of an inventive ceiling hanger in use as a means for suspending a houseplant from a ceiling.
Figure 2:
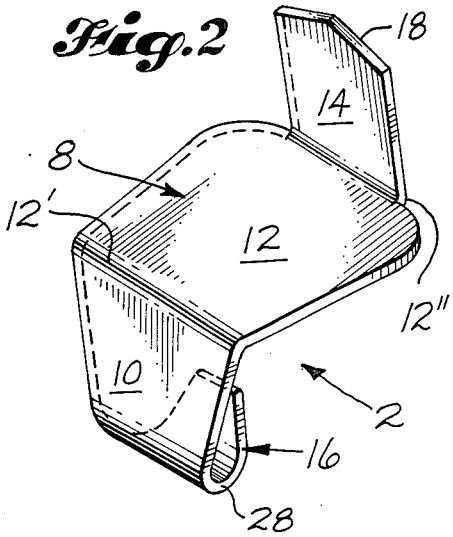
FIG. 2 is an enlarged perspective view of the hanger.
Figure 4:
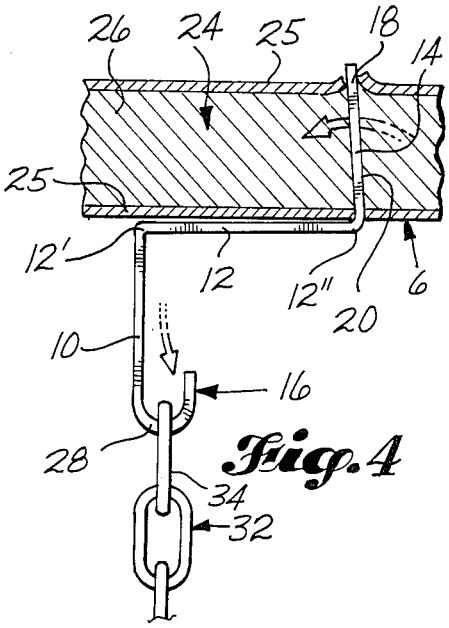
FIG. 4 is a cross-sectional view similar to that in FIG. 3, but at 90-degrees to the same, illustrating the hanger in use to support the plant in FIG. 1.

Referring to the drawing, it will be seen that the inventive ceiling hanger 2 has a rigid, generally Z-shaped body 8 which has three successively interconnected body sections 10, 12, 14, the intermediate section 12 of which is arranged substantially on a parallel to the ceiling 6 in use, as in FIGS. 1 and 4. One end section 10 of the hanger 2 operatively depends from the intermediate section 12 of the hanger at one end 12' thereof; while the other end section 14 upstands from the other end 12" of the intermediate section. The depending end section 10 has a hook 16 on the relatively lower end portion thereof, from which the houseplant 4 is suspended in use. The upstanding end section 14 has a pointed tip 18 on the relatively upper end portion thereof, whereby when the intermediate section 12 of the hanger is disposed substantially parallel to the ceiling 6, the upstanding end section 14 of the same can be bayonetted into the ceiling to abut the intermediate section 12 against the ceiling and thereby position the depending end section 10 below the ceiling as an attachment site for the plant. Meanwhile, the hook 16 of the depending end section 10 is spaced apart from the connection 12" between the intermediate and upstanding end sections 12, 14 of the hanger so that when the plant 4 is attached to the hanger at the hook, the plant generates sufficient moment about the connection 12" to bind or jam the upstanding end section 14 of the hanger in the hole 20 occupied by the same, and thus prevent the hanger from disengaging from the ceiling.

Figure 3:
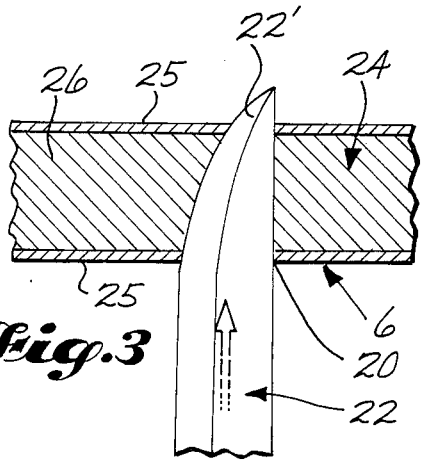
FIG. 3 is a part cross-sectional view of the ceiling itself, illustrating the use of a knife tip to make a slit-like incision for the hanger.

As illustrated in FIG. 3, the hole 20 may be preformed by using the tip 22' of a knife 22 to make a slit-like incision in the ceiling 6 before the upstanding end section 14 of the hanger is bayonetted into the same.

Referring to FIG. 4 in particular, it will be seen, moreover, that the intermediate and upstanding end sections 12, 14 of the hanger are disposed at slightly less than 90 degrees to one another to aid in the binding effect achieved by the downward force of the plant on the hook. Commonly, an 87-degree angle is employed.

Furthermore, to augment the effect, the hook 16 is disposed on the same side of the depending end section 10 of the hanger, as is the intermediate section 12 thereof. However, the hook may be disposed on the outboard side of the depending end section, if desired, and the effect will not be lost.

The ceiling 6 may be panel-like in construction, and the panel 24 may have a known thickness, such as the ½-inch thickness which is common to plasterboard. In such a case, the upstanding end section 14 may penetrate both the bottom cover layer 25 and the top cover layer 25 of the panel, as well as the intermediate fill layer 26 therebetween, as seen in FIG. 4 in particular.

The hook 16 on the depending end section 10 preferably has a rounded bight 28, and is sized to allow for engaging the eye 34 of a chain 32 thereover, such as that used to suspend the planterbox 30 of a common houseplant 4.

I claim:

1. A ceiling hanger for use in a generally horizontal ceiling of relatively penetrable plasterboard material or the like, said hanger consisting of:

a rigid, generally Z-shaped body consisting essentially of three successive, unitary body sections, the intermediate section of which is substantially planar and the end sections of which are oppositely disposed to one another at the opposing ends of the intermediate section and relatively depend from and upstand from the intermediate section at substantially 90° to the same, respectively, the relatively depending end section of the hanger having a hook on the relatively lower end portion thereof, the relatively upstanding end section of the hanger having knife-edge-like incision making means on the relatively upper end portion thereof, whereby when the intermediate section of the hanger is disposed substantially parallel to the ceiling in use, the relatively upstanding end section of the same can be bayonetted into the ceiling to abut the intermediate section broadside against the ceiling and thereby position the depending end section of the hanger below the ceiling as an attachment site whereby an article of up to about fifteen pounds in weight can be suspended from the hanger on the hook, and the intermediate section being of such length from end to end thereof that when such an article is attached to the hanger at the hook, the article generates sufficient moment about the connection between the intermediate and upstanding end sections of the hanger to bind or jam the upstanding end section in the hole occupied by the same, and thus prevent the hanger from disengaging from the ceiling.

2. The ceiling hanger according to claim 1 wherein the intermediate and upstanding end sections of the hanger are disposed at slightly less than 90 degrees to one another, to aid in the binding effect achieved by the downward force of the article on the hook.

3. The ceiling hanger according to claim 1 wherein the hook is disposed on the same side of the depending end section of the hanger, as is the intermediate section thereof.

4. The ceiling hanger according to claim 1 wherein the incision-making means take the form of a pointed tip on the relatively upper end portion of the upstanding end section of the hanger.

5. In combination, overhead means defining a generally horizontal ceiling of relatively penetrable plasterboard material or the like having a hole therein, and a ceiling hanger consisting of a rigid, generally Z-shaped body consisting essentially of three successive, unitary body sections, the intermediate section of which is substantially planar and abutted broadside against the ceiling, substantially on a parallel thereto, and the end sections of which depend from the intermediate section of the hanger at one end thereof, and upstand from the other end of the intermediate section in the hole of the ceiling, at substantially 90° to the intermediate section, respectively, the relatively upstanding end section of the hanger having knife-edge-like incision making means on the relatively upper end portion thereof, the relatively depending end section of the hanger having a hook on the relatively lower end portion thereof and an article weighing up to about fifteen pounds suspended from the hanger on the hook, and the intermediate section being of such length from end to end thereof that the article generates sufficient moment about the connection between the intermediate and upstanding end sections of the hanger to bind or jam the upstanding end section in the hole, and thus prevent the hanger from disengaging from the ceiling.

6. The combination according to claim 5 wherein the intermediate and upstanding end sections of the hanger are disposed at slightly less than 90 degrees to one another, to aid in the binding effect achieved by the downward force of the article on the hook.

7. The combination according to claim 5 wherein the hook is disposed on the same side of the depending end section of the hanger, as is the intermediate section thereof.

8. The combination according to claim 5 wherein the relatively upper end portion of the upstanding end section of the hanger has a pointed tip thereon.

9. A method of hanging an article weighing up to about fifteen pounds from a generally horizontal ceiling of relatively penetrable plasterboard material or the like, comprising;

arranging a hanger adjacent the ceiling which has three successive, unitary body sections, rigidly interconnected in a general Z-shape, the intermediate section of which is substantially planar and arranged substantially on a parallel to the ceiling, and the end sections of which depend from the intermediate section of the hanger at one end thereof, and upstand from the other end of the intermediate section, respectively, the depending end section of the hanger having a hook on the relatively lower end portion thereof, and the upstanding end section of the hanger having knife-edge-like incision making means on the relatively upper end portion thereof, bayonetting the upstanding end section of the hanger into the ceiling to abut the intermediate section broadside against the ceiling and thereby position the depending end section of the hanger below the ceiling, and suspending the article from the hanger on the hook, the depending end section of the hanger depending at substantially 90° to the intermediate section and the hook of the same being spaced apart from the connection between the intermediate and upstanding end sections of the hanger so that the article generates sufficient moment about the connection to bind or jam the upstanding end section of the hanger in the ceiling, and thus prevent the hanger from disengaging from the ceiling.

10. The method according to claim 9 wherein a slit-like incision is made in the ceiling with a knife or the like and the upstanding end section of the hanger is then bayonetted into the incision.

11. The method according to claim 9 wherein the upstanding end section of the hanger is disposed at slightly less than 90° to the intermediate section, to aid in the binding effect achieved by the downward force of the article on the hook.

12. The method according to claim 9 wherein the hook is disposed on the same side of the depending end section of the hanger as is the intermediate section thereof.

* * * * *